US007030309B2

(12) United States Patent
Kubita

(10) Patent No.: US 7,030,309 B2
(45) Date of Patent: Apr. 18, 2006

(54) ELECTRONIC MUSICAL APPARATUS AND PROGRAM FOR ELECTRONIC MUSIC

(75) Inventor: Akemi Kubita, Hamamatsu (JP)

(73) Assignee: Yamaha Corporation, (JP)

( * ) Notice: Subject to any disclaimer, the term of this patent is extended or adjusted under 35 U.S.C. 154(b) by 259 days.

(21) Appl. No.: 10/340,998

(22) Filed: Jan. 13, 2003

(65) Prior Publication Data

US 2003/0131719 A1 Jul. 17, 2003

(30) Foreign Application Priority Data

Jan. 11, 2002 (JP) ..... 2002-004875

(51) Int. Cl.
*G10H 1/18* (2006.01)

(52) U.S. Cl. ..... 84/622; 84/659

(58) Field of Classification Search ..... 84/622, 84/659, 735, 623–625, 660–661, 693–700
See application file for complete search history.

(56) References Cited

U.S. PATENT DOCUMENTS 5,698,806 A * 12/1997 Yamada et al. ..... 84/615
5,841,054 A * 11/1998 Komano et al. ..... 84/622
5,998,722 A 12/1999 Kondo ..... 84/622

FOREIGN PATENT DOCUMENTS

JP 59-197090 11/1984

* cited by examiner

*Primary Examiner*—Marlon T. Fletcher
*Assistant Examiner*—David S. Warren
(74) *Attorney, Agent, or Firm*—Rossi, Kimms & McDowell, LLP

(57) ABSTRACT

There is provided an electronic musical apparatus that is capable of providing listenable performance by using data reflecting the intention of the user among usable data, as well as a program for electronic music. A tone generator device is capable of sounding musical tones based on data representing preset musical tone control information or user musical tone control information. When data representing musical tone control information that is inputted is data representing user musical tone control information incapable of being sounded by a tone generator circuit and the data representing the user musical tone control information includes data representing original preset musical tone control information as a basis of the user musical tone control information, a CPU sends the data representing the original preset musical tone control information as an alternative to the data representing the user musical tone control information to the tone generator circuit and causes the tone generator circuit to sound musical tones based on the original preset musical tone control information.

9 Claims, 13 Drawing Sheets

*FIG. 3*

| GROUP NAME | LOW GRADE MODEL | | INTERMEDIATE AND HIGH GRADE MODEL | |
|---|---|---|---|---|
| Piano (1-5) | 1<br>3 | GrandPiano<br>ElePiano | 1 | GrandPiano |
| | | | 2 | BritePiano |
| | | | 3 | ElectricPiano |
| | | | 4 | Harpsichord |
| | | | 5 | Clavi |
| Chro-Percussion (6-10) | 6<br>9 | Celesta<br>Marimba | 6 | Celesta |
| | | | 7 | Gloken |
| | | | 8 | MusicBox |
| | | | 9 | Marimba |
| | | | 10 | Xylophone |
| Organ (11-15) | 11<br>13 | DrawOrgan<br>ReedOrgan | 11 | DrawOrgan |
| | | | 12 | ChurchOrgan |
| | | | 13 | ReedOrgan |
| | | | 14 | Accordion |
| | | | 15 | Harmonica |

*FIG. 4*

| GROUP NAME | ELECTRONIC MUSICAL INSTRUMENT | | HIGH GRADE MODEL | |
|---|---|---|---|---|
| Reverb (1-5) | 1<br>5 | Hall1<br>Stage | 1 | Hall1 |
| | | | 2 | Hall2 |
| | | | 3 | Room1 |
| | | | 4 | Room2 |
| | | | 5 | Stage |
| Chorus (6-10) | 6<br>8 | Chorus1<br>Celeste1 | 6 | Chorus1 |
| | | | 7 | Chorus2 |
| | | | 8 | Celeste1 |
| | | | 9 | Celeste2 |
| | | | 10 | Flanger |
| | | | | |

*FIG. 5*

| |
|---|
| PRESET TONE COLOR NUMBER |
| MUSICAL TONE WAVEFORM |
| VOLUME AND PAN |
| FILTER |
| EFFECT |
| ENVELOPE |
| ⋮ |

*FIG. 7*

| REGISTRATION 1 | REGISTRATION 2 | REGISTRATION 3 | REGISTRATION 4 |
|---|---|---|---|
| TEMPO 1 (NUMBER OF QUARTER NOTES/MINUTE)<br>VOLUME 1 (0-127)<br>TONE COLOR 1 (NUMBER)<br>STYLE 1 (NUMBER) | TEMPO 2<br>VOLUME 2<br>TONE COLOR 2<br>STYLE 2 | TEMPO 3<br>VOLUME 3<br>TONE COLOR 3<br>STYLE 3 | TEMPO 4<br>VOLUME 4<br>TONE COLOR 4<br>STYLE 4 |
| TONE COLOR PARAMETERS OF TONE COLOR 1<br>· ORIGINAL PRESET TONE COLOR NUMBER<br>· VOLUME AND PAN<br>· FILTER<br>· EFFECT<br>· ENVELOPE | TONE COLOR PARAMETERS OF TONE COLOR 2 | TONE COLOR PARAMETERS OF TONE COLOR 3 | TONE COLOR PARAMETERS OF TONE COLOR 4 |

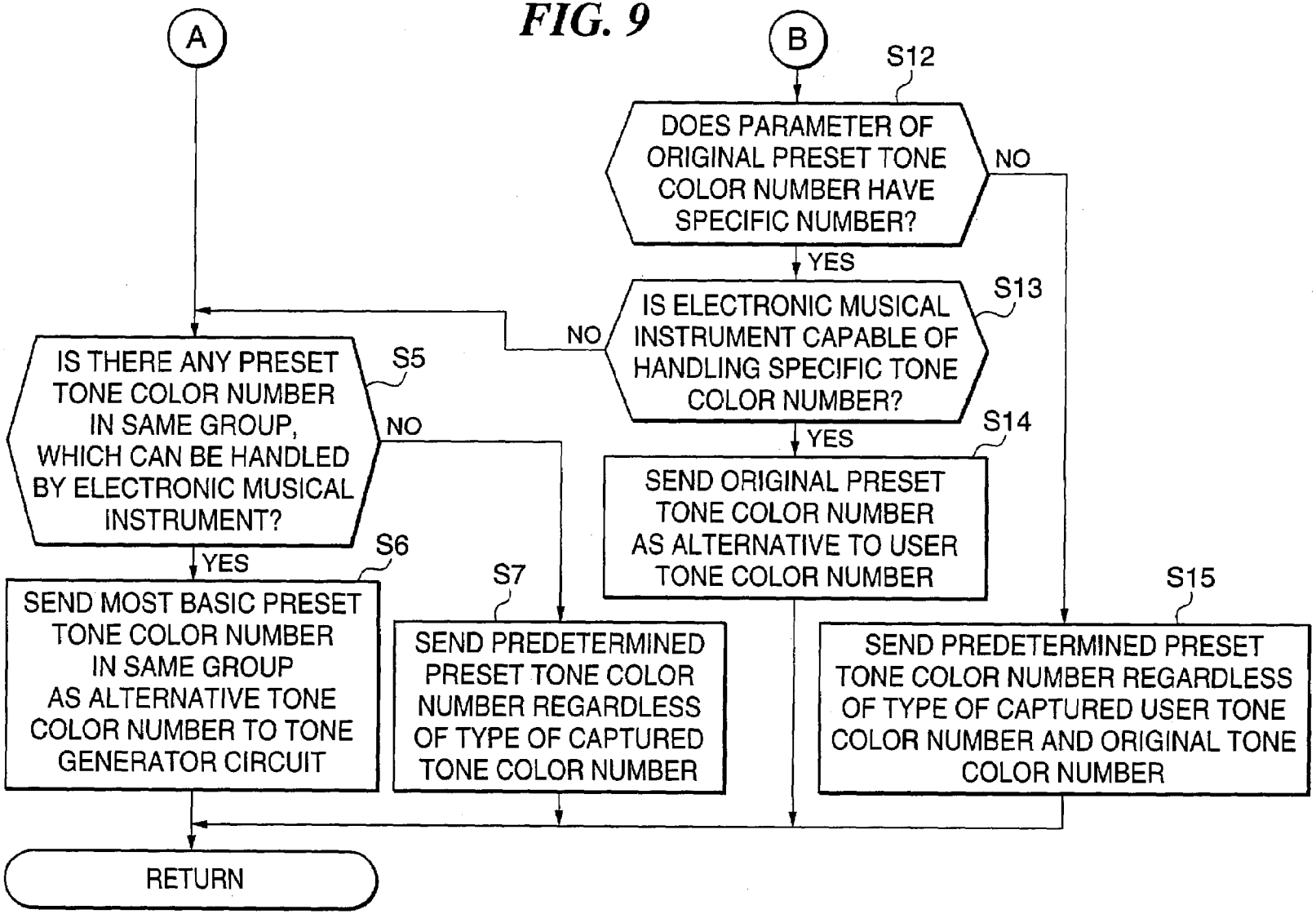
FIG. 9
A
B
S5
IS THERE ANY PRESET TONE COLOR NUMBER IN SAME GROUP, WHICH CAN BE HANDLED BY ELECTRONIC MUSICAL INSTRUMENT?
NO
YES
S6
SEND MOST BASIC PRESET TONE COLOR NUMBER IN SAME GROUP AS ALTERNATIVE TONE COLOR NUMBER TO TONE GENERATOR CIRCUIT
S7
SEND PREDETERMINED PRESET TONE COLOR NUMBER REGARDLESS OF TYPE OF CAPTURED TONE COLOR NUMBER
S12
DOES PARAMETER OF ORIGINAL PRESET TONE COLOR NUMBER HAVE SPECIFIC NUMBER?
NO
YES
S13
IS ELECTRONIC MUSICAL INSTRUMENT CAPABLE OF HANDLING SPECIFIC TONE COLOR NUMBER?
NO
YES
S14
SEND ORIGINAL PRESET TONE COLOR NUMBER AS ALTERNATIVE TO USER TONE COLOR NUMBER
S15
SEND PREDETERMINED PRESET TONE COLOR NUMBER REGARDLESS OF TYPE OF CAPTURED USER TONE COLOR NUMBER AND ORIGINAL TONE COLOR NUMBER
RETURN

*FIG. 11*

| ORIGINAL MUSICAL TONE WAVEFORM | TONE COLOR NUMBER | TONE COLOR NAME | FIRST MUSICAL TONE WAVEFORM | SECOND MUSICAL TONE WAVEFORM |
|---|---|---|---|---|
| 1,2 | 001 | GrandPiano | 1 | 2 |
| | 003 | ElePiano | 1 | 2 |
| 3,4 | 026 | Strings1 | 3 | 4 |
| 5 | 052 | Strings2 | 5 | 0 |
| 7 | 081 | Strings3 | 7 | 8 |
| ⋮ | ⋮ | ⋮ | ⋮ | ⋮ |
| 33 | 002 | BritePiano | 33 | 0 |
| 35 | 054 | Violin2 | 0 | 35 |
| | 084 | Violin3 | 0 | 35 |
| 41 | 161 | Violin4 | 0 | 41 |
| ⋮ | ⋮ | ⋮ | ⋮ | ⋮ |

*FIG. 12*

| REGISTRATION 1 | REGISTRATION 2 | REGISTRATION 3 | REGISTRATION 4 | |
|---|---|---|---|---|
| TEMPO 1 (NUMBER OF QUARTER NOTES/MINUTE)<br>VOLUME 1 (0-127)<br>TONE COLOR 1 (NUMBER)<br>STYLE 1 (NUMBER) | TEMPO 2<br>VOLUME 2<br>TONE COLOR 2<br>STYLE 2 | TEMPO 3<br>VOLUME 3<br>TONE COLOR 3<br>STYLE 3 | TEMPO 4<br>VOLUME 4<br>TONE COLOR 4<br>STYLE 4 | |
| TONE COLOR PARAMETERS OF TONE COLOR 1<br>· ORIGINAL MUSICAL TONE WAVEFORM NUMBER<br>· VOLUME AND PAN<br>· FILTER<br>· EFFECT<br>· ENVELOPE | TONE COLOR PARAMETERS OF TONE COLOR 2 | TONE COLOR PARAMETERS OF TONE COLOR 3 | TONE COLOR PARAMETERS OF TONE COLOR 4 | |
| · ORIGINAL MUSICAL TONE WAVEFORM NUMBER<br>· VOLUME AND PAN<br>· FILTER<br>· EFFECT<br>· ENVELOPE | | | | |

ELECTRONIC MUSICAL APPARATUS AND PROGRAM FOR ELECTRONIC MUSIC

BACKGROUND OF THE INVENTION

1. Field of the Invention

The present invention relates to an electronic musical apparatus that has a function of substituting usable preset musical tone control information for unusable user musical tone control information, as well as a program for electronic music.

2. Description of the Related Art

Conventionally, electronic musical instruments have been known which generate a musical tone signal, i.e. carries out performance based on tone color data set in the instruments in advance (preset tone color data) or user tone color data that is produced by the user by editing the preset tone color data.

Among such electronic musical instruments, relatively inexpensive low and intermediate grade models read user tone color data that is produced separately by intermediate and high grade models. If a tone generator provided in the low and intermediate models is incapable of handling the user tone color data, tones cannot be sounded based on the user tone color data. To address this problem, predetermined preset tone color data is sent as alternative tone color data to the tone generator, and the tone generator sounds tones based on the predetermined preset tone color data.

Specifically, because tone generators provided in low and intermediate grade electronic musical instruments are incapable of handling user tone color data themselves and tone generators provided in intermediate grade electronic musical instruments are capable of handling basic user tone color data but are incapable of handling high grade user tone color data, grand piano tone color data as one of preset tone color data provided in these electronic musical instruments is sent to the tone generators, which sound tones based on the received grand piano tone color data.

The above described conventional electronic musical instruments can sound tones without fail, but cannot provide performance offensive to the ear because the alternative tone color data is greatly different from user tone color data that is set intentionally by the user.

For example, if the user sets panpipe tone color data as user tone color data in a high grade electronic musical instrument and desires to sound tones by a low grade electronic musical instrument based on the user tone color data, the low grade electronic musical instrument sounds tones based on predetermined grand piano tone color data because it is not capable of handling the user tone color data itself, that is, it is not capable of sounding tones based on the user tone color data. In this case, the performance provided by the low grade electronic musical instrument is offensive to the ear because the grand piano tone color is greatly different from the panpipe tone color intended by the user.

SUMMARY OF THE INVENTION

It is therefore an object of the present invention to provide an electronic musical apparatus that is capable of providing listenable performance by using data reflecting the intention of the user among usable data, as well as a program for electronic music.

To attain the above object, in a first aspect of the present invention, there is provided an electronic musical apparatus comprising a tone generator that generates a musical tone signal based on musical tone control information, the musical tone control information including preset musical tone control information based on which the tone generator generates a musical tone and user musical tone control information which a user produces by editing the preset musical tone control information, an input that inputs the musical tone control information, and a controller that controls, when the input musical tone control information includes the user musical tone control information based on which the tone generator can't generate a musical tone signal, the tone generator to generate the musical tone signal corresponding to the preset musical tone control information included in the input musical tone control information instead of generating the musical tone signal corresponding to the user musical tone control information.

According to the first aspect of the present invention, when the input musical tone control information includes the user musical tone control information based on which the tone generator can't generate a musical tone signal, the tone generator is controlled to generate the musical tone signal corresponding to the preset musical tone control information included in the input musical tone control information instead of generating the musical tone signal corresponding to the user musical tone control information. Therefore, it is possible to provide listenable performance by using data reflecting the intention of the user among usable data.

Preferably, the musical tone control information is indicative of musical tone control information numbers and/or musical tone control information parameters, and the musical tone control information is indicative of the tone color, effect, accompaniment style, and the like.

Preferably, the controller is operable when the input musical tone control information includes no preset musical tone control information, for sending predetermined preset musical tone control information capable of being used by the tone generator as an alternative to the user musical tone control information to the tone generator, and for controlling the tone generator to generate a musical tone signal based on the predetermined preset musical tone control information.

Therefore, the tone generator can always sound tones by using alternative tone color data.

Preferably, the electronic musical apparatus further comprises a storage that classifies a plurality of preset musical tone control information into groups according to characteristics thereof and stores the classified preset musical tone control information for each of the groups, wherein the controller is operable when the preset musical tone control information as a basis of the user musical tone control information is incapable of being used by the tone generator, for sending preset musical tone control information belonging to the same group as the preset musical tone control information capable of being used by the tone generator to the tone generator and for controlling the tone generator to generate a musical tone signal based on the sent preset musical tone control information.

Therefore, it is possible to provide listenable performance by using data that reflects the intention of the user to a larger degree among usable data.

Preferably, the plurality of the preset musical tone control information is classified according to the characteristics such as the types of musical instruments.

Preferably, the electronic musical apparatus is an apparatus selected from the group consisting of a personal computer, a mobile computer, a game machine, and a portable communication terminal.

To attain the above object, the first aspect of the present invention further provides a program for electronic music, which is executed by a computer including a tone generator device capable of generating a musical tone signal based on musical tone control information, the musical tone control information including preset musical tone control information based on which the tone generator generates a musical tone and user musical tone control information which a user produces by editing the preset musical tone control information, the program comprising an input module that inputs the musical tone control information, and a control module that controls, when the input musical tone control information includes the user musical tone control information based on which the tone generator can't generate a musical tone signal, the tone generator to generate the musical tone signal corresponding to the preset musical tone control information included in the input musical tone control information instead of generating the musical tone signal corresponding to the user musical tone control information.

To attain the above object, in a second aspect of the present invention, there is provided an electronic musical apparatus comprising a tone generator capable of sounding musical tones based on preset tone color data including a plurality of musical tone waveform data to which are assigned corresponding numbers common to another electronic musical apparatus, an input that inputs tone color data relating to musical tones to be sounded, a storage that stores a plurality of preset tone color data including a plurality of musical tone waveform data capable of being used by the tone generator, and a controller that is operable when the tone color data inputted by the input is not user tone color data capable of being used by the tone generator, the user tone color data being produced by a user by editing original tone color data as a basis thereof, and the user tone color data includes the data for identifying or specifying the original musical tone waveform as a basis thereof, for sending the data for identifying or specifying the original musical tone waveform among the plurality of preset tone color data stored in the storage as an alternative to the user tone color data to the tone generator and for controlling the tone generator to generate a musical tone signal based on the data for identifying or specifying the original musical tone waveform.

According to the second aspect of the present invention, in the case where the tone color data inputted by the input is user tone color data incapable of being used by the tone generator, the user tone color data being produced by a user by editing original tone color data as a basis thereof, and the user tone color data includes the data for identifying or specifying the original musical tone waveform as a basis thereof, for sending the data for identifying or specifying the original musical tone waveform among the plurality of preset tone color data stored in the storage is sent as an alternative to the user tone color data to the tone generator, which then generate a musical tone signal based on data for identifying or specifying the original musical tone waveform. Therefore, it is possible to provide listenable performance by using data reflecting the intention of the user among usable data.

Preferably, the tone color data is indicative of tone color numbers and/or tone color parameters, and the musical tone waveform data is indicative of musical tone waveform numbers.

Preferably, the controller is operable when a plurality of data including the data for identifying or specifying the original musical tone waveform are included in the plurality of preset tone color data stored in the storage, for sending one preset tone color data including the data for identifying or specifying the original musical tone waveform among the plurality of data to the tone generator in accordance with a predetermined order of priorities and for controlling the tone generator to generate a musical tone signal based on the one preset tone color data.

Therefore, the tone generator can always sound tones by using alternative tone color data.

Preferably, the predetermined order of priorities means that musical tone waveform data with a smaller or larger number assigned thereto is selected with priority. This order of priorities is set in advance in the electronic musical apparatus by the user or the manufacturer thereof.

Preferably, the electronic musical apparatus is an apparatus selected from the group consisting of a personal computer, a mobile computer, a game machine, and a portable communication terminal.

To attain the above object, the second aspect of the present invention further provides a program for electronic music, which is executed by a computer including a tone generator capable of sounding musical tones based on preset tone color data including a plurality of musical tone waveform data to which are assigned corresponding numbers common to another electronic musical apparatus, and a storage device that stores data to be used by the tone generator device, the program comprising an input module that inputs tone color data relating to musical tones to be sounded, a storage module that stores a plurality of preset tone color data including a plurality of musical tone waveform data capable of being used by the tone generator, and a control module that is operable when the tone color data inputted by the input module is not user tone color data capable of being used by the tone generator, the user tone color data being produced by a user by editing original tone color data as a basis thereof, and the user tone color data includes the data for identifying or specifying the original musical tone waveform as a basis thereof, for sending the data for identifying or specifying the original musical tone waveform among the plurality of preset tone color data stored in the storage as an alternative to the user tone color data to the tone generator and for controlling the tone generator to generate a musical tone signal based on the data for identifying or specifying the original musical tone waveform.

The above and other objects, features, and advantages of the invention will become more apparent from the following detailed description taken in conjunction with the accompanying drawings.

BRIEF DESCRIPTION OF THE DRAWINGS

FIG. 3 is a schematic diagram of a preset tone color table showing the contents of preset tone number data 64 in FIG. 2;

FIG. 4 is a schematic diagram showing a preset effect table showing the contents of preset effect number data 65 in FIG. 2;

FIG. 5 is a schematic diagram showing the contents of data stored in a tone generator circuit 12 in FIG. 1;

FIG. 7 is a diagram showing the contents of an external storage device 10, which are taken into an electronic musical instrument 100 in FIG. 1;

FIG. 9 is a flow chart showing a continued part of the user tone color data substituting process carried out by the CPU 5 in FIG. 1;

FIG. 11 is a diagram showing a conversion table for use in extracting a preset tone color number or the like according to an original musical tone waveform number in FIG. 10;

FIG. 12 is a diagram showing the contents of the external storage device 10, which are taken into the electronic musical instrument 100 in FIG. 1;

DETAILED DESCRIPTION OF THE PREFERRED EMBODIMENTS

The present invention will now be described in detail with reference to the drawings showing preferred embodiments thereof.

Figure 1:
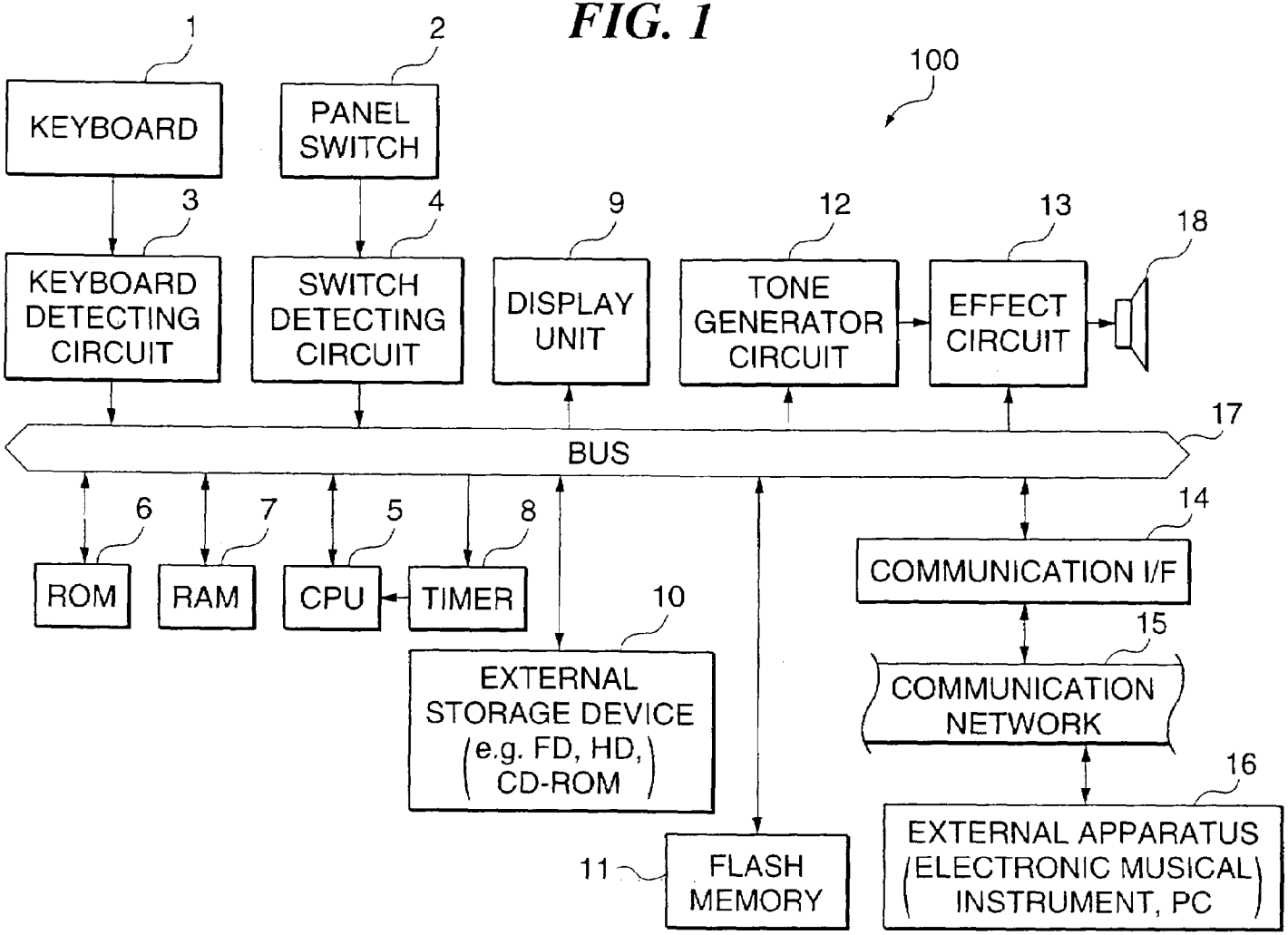
FIG. 1 is a schematic block diagram showing the arrangement of an electronic musical apparatus according to a first embodiment of the present invention.

FIG. 1 is a schematic block diagram showing the arrangement of an electronic musical apparatus according to a first embodiment of the present invention. In the present embodiment, the electronic musical apparatus according to the present embodiment is applied as an electronic musical instrument 100.

As shown in FIG. 1, the electronic musical instrument 100 is comprised of a keyboard 1 for inputting tone pitch information; a panel switch 2 comprised of a plurality of switches for inputting a variety of information; a key depression detecting circuit 3 that detects the depression of each key of the keyboard 1; a switch detecting circuit 4 that detects the depression of each switch of the panel switch 2; a CPU 5 that controls the overall operations of the electronic musical instrument 100, a ROM 6 that stores control programs that are executed by the CPU 5 and a variety of table data and tone color numbers given to tone color data as described later; a RAM 7 that temporarily stores a variety of input information, calculation results, and so forth; a timer 8 that measures an interrupt time in a timer interrupt process and other periods of times, a display unit 9 that is comprised of a large-sized liquid crystal display (LCD) or CRT (Cathode Ray Tube) display, light emitting diodes (LED), and so forth; an external storage device 10 that stores a variety of application programs including the above-mentioned control programs, images, a variety of data, and so forth; a flash memory 11 that stores user tone color data, described later; a tone generator circuit 12 that converts performance data inputted from the keyboard 1, preset performance data, or the like into a musical tone signal; an effect circuit 13 that gives a variety of effects to the musical tone signal received from the tone generator circuit 12; a sound system 18 such as a DAC (Digital-to-Analog Converter), amplifier, or speaker that converts the musical tone signal received from the effect circuit 13 into sounds; and a communication interface (I/F) 14 that provides interface for sending and receiving data to and from an external apparatus 16 such as another electronic musical instrument or a personal computers via a communication network 15.

The above-mentioned component parts 3 to 13 are connected to each other via a bus 17, and the timer 8 is connected to the CPU 5. The external storage device 10 is provided with a storage medium such as a flexible disk (FD), hard disk (HD), or CD-ROM, and a device that reads and writes data from and into the storage medium. The external storage device 10 is for addition of control programs, version upgrade, and so forth. The electronic musical instrument 100 is capable of not only adding control programs and upgrading the version but also capturing data from the external apparatus 16 via the communication I/F 14 and the communication network 15.

The external apparatus 16 is connected to the bus 17 via the communication I/F 14 and the communication network 15. If the communication I/F 14 is provided with a serial communication terminal, parallel communication terminal, USB (Universal Serial Bus), IEEE 1394, or the like, the external apparatus 16 may not be connected to the communication I/F 14 via the communication network 15 but may be directly connected to the communication I/F 14 via a connection cable for the serial communication terminal or the like.

Intermediate and high grade electronic musical instruments are provided with the flash memory 11 that stores the user tone color data, whereas low grade musical instruments are not provided with the flash memory 11.

A description will now be given of the structure of data stored in the ROM 6 with reference to FIG. 2.

The data stored in the ROM 6 is comprised of operating system and control program data 61; sample musical composition data 62; preset style data 63 including preset style number data for use in designating preset style data and MIDI data corresponding to the preset style number data; preset tone color number data 64 for use in designating preset tone color data; preset effect number data 65 for use in designating preset effect data; setting data (i.e. registration data) 66 for use in setting the tempo, volume, tone color, style and the like; and other data 67. The musical composition data 62 is of the MIDI format, for example, but this is not limitative.

Both the preset tone color number data 64 and the preset effect number data 65 are nothing but number data for identifying or specifying a tone color and an effect to be given to the musical tone. The actual preset tone color data designated by the preset tone color number data 64 is contained in the tone generator circuit 12 and the actual preset effect data designated by the preset effect number data 65 are contained in the effect circuit 13. That is, the preset tone color data are set in the electronic musical instrument 100 in advance.

For example, if the user designates a preset tone color number "1" by operating the panel switch 2, the tone generator circuit 12 selects preset tone color data corresponding to the preset tone color number "1" to generate a musical tone signal based on the selected preset tone color data.

Regarding the preset style data 63, upon designation of preset style number data, MIDI data corresponding to the number data is read, and event data constituting the MIDI data is sent to the tone generator circuit 12 to generate a musical tone signal based on the event data as is the case with the musical composition data 62.

The contents of the data stored in the ROM 6 are the same in intermediate and high grade electronic musical instruments and low grade electronic musical instruments.

Figure 2:
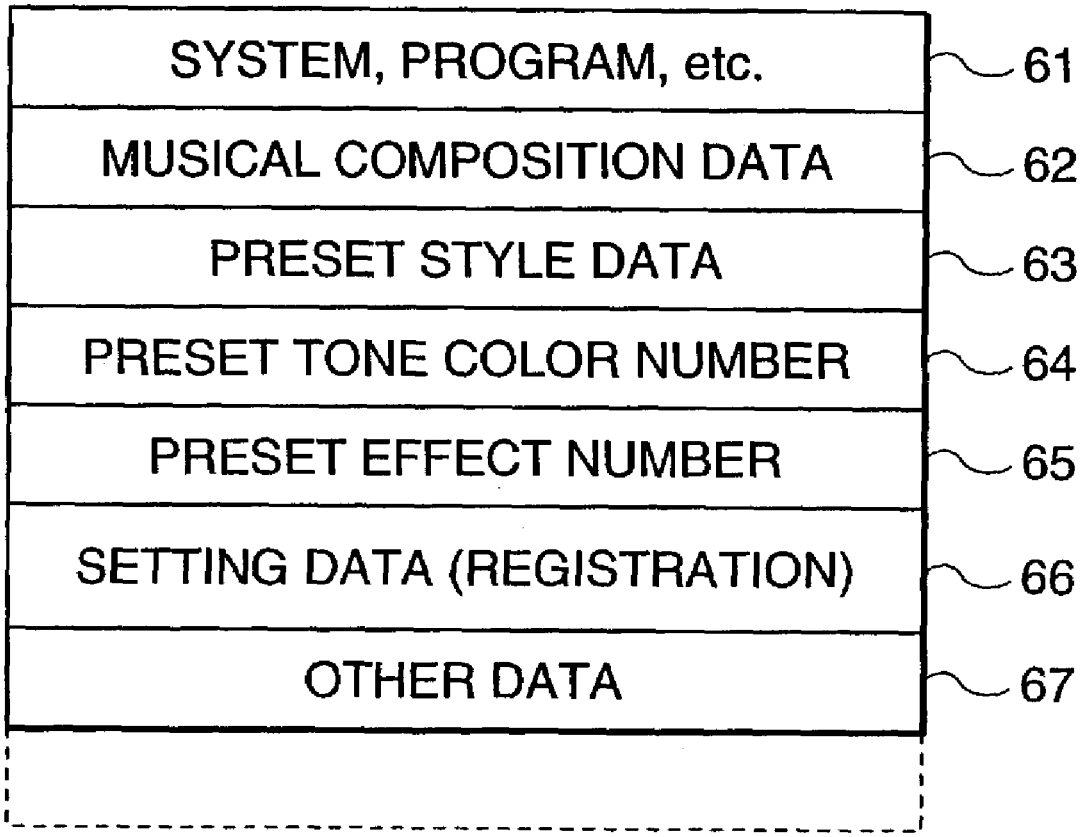
FIG. 2 is a schematic diagram showing the contents of data stored in a ROM 6 in FIG. 1.

FIG. 3 is a schematic diagram of a preset tone color table showing the contents of the preset tone color number data 64 in FIG. 2.

The preset tone color table shows preset tone color numbers corresponding to preset tone color data that are stored in the tone generator circuit 12 according to groups which are formed by grouping a plurality of the preset tone color number data 64 according to the characteristics thereof (i.e. instruments). For example, for a group of pianos, there are provided preset tone color numbers "1" to "5". Low grade electronic musical instruments are capable of handling the preset tone color number "1" designating "Grand Piano" and the preset tone color number "2" designating "Electronic Piano", and intermediate and high grade electronic music instruments are capable of handling all of the preset tone color numbers 1 to 5. This means that the tone generator circuit 12 provided in the low grade electronic musical instruments has preset tone color data corresponding to the preset tone color numbers "1" and "3", and only in the case where either of the preset tone color data is selected, a musical tone signal can be generated based on the selected preset tone color data. In other words, in the case where the preset tone color number "2" is selected, a musical tone signal cannot be generated based on preset tone color data because the tone generator circuit 12 does not contain the preset tone color data corresponding to the selected preset tone color number "2". On the other hand, the tone generator circuit 12 provided in intermediate and high grade electronic musical instruments has preset tone color data corresponding to all of the preset tone color numbers "1" to "5", and therefore, no matter which preset tone color number is selected, a musical tone signal can be generated based on the preset tone color data corresponding to the selected preset tone color number.

Because both intermediate and high grade electronic musical instruments and low grade electronic musical instruments are provided with the preset tone color table, the low grade electronic musical instruments can determine what group a preset tone color number belongs to even if they are incapable of handling the preset tone color number.

Further, the preset tone color table may contain a large number of tone color groups or tone color types as is the case with the general MIDI standards.

Further, if preset tone color numbers and musical tone waveforms correspond to each other on a one-to-one basis, the preset tone color table also specifies a musical tone waveform table.

FIG. 4 is a schematic diagram of a preset effect table showing the contents of the preset effect number data 65 in FIG. 2.

The preset effect table is provided in both intermediate and high grade electronic musical instruments and low grade electronic musical instruments as is the case with the above described preset tone color table.

Further, as is the case with the preset tone color table, in low grade electronic musical instruments, only in the case where a preset effect number corresponding to certain preset effect data is selected, the effect circuit 13 gives a variety of effects to a musical tone signal from the tone generator circuit 12 based on the preset effect data corresponding to the selected preset effect number. On the other hand, in intermediate and high grade electronic musical instruments, whichever preset effect number is selected, the effect circuit 13 gives a variety of effects to a musical tone signal from the tone generator circuit 12 based on preset effect data corresponding to the selected preset effect number.

FIG. 5 is a diagram showing the contents of data stored in the tone generator circuit 12 in FIG. 1.

As shown in FIG. 5, the tone generator circuit 12 stores data on preset tone color numbers, preset tone color data, i.e. musical tone waveforms corresponding to the preset tone color numbers, as well as data on volume and pan, filter, effect, and envelope. This set of data is provided for each preset tone color number. The volume of a musical tone signal is determined according to a value of the velocity in MIDI event data received by the tone generator circuit 12. In the case where the tone generator circuit 12 receives MIDI data corresponding to other tone color data, the other tone color data is changed based on the received MIDI data.

Figure 6:
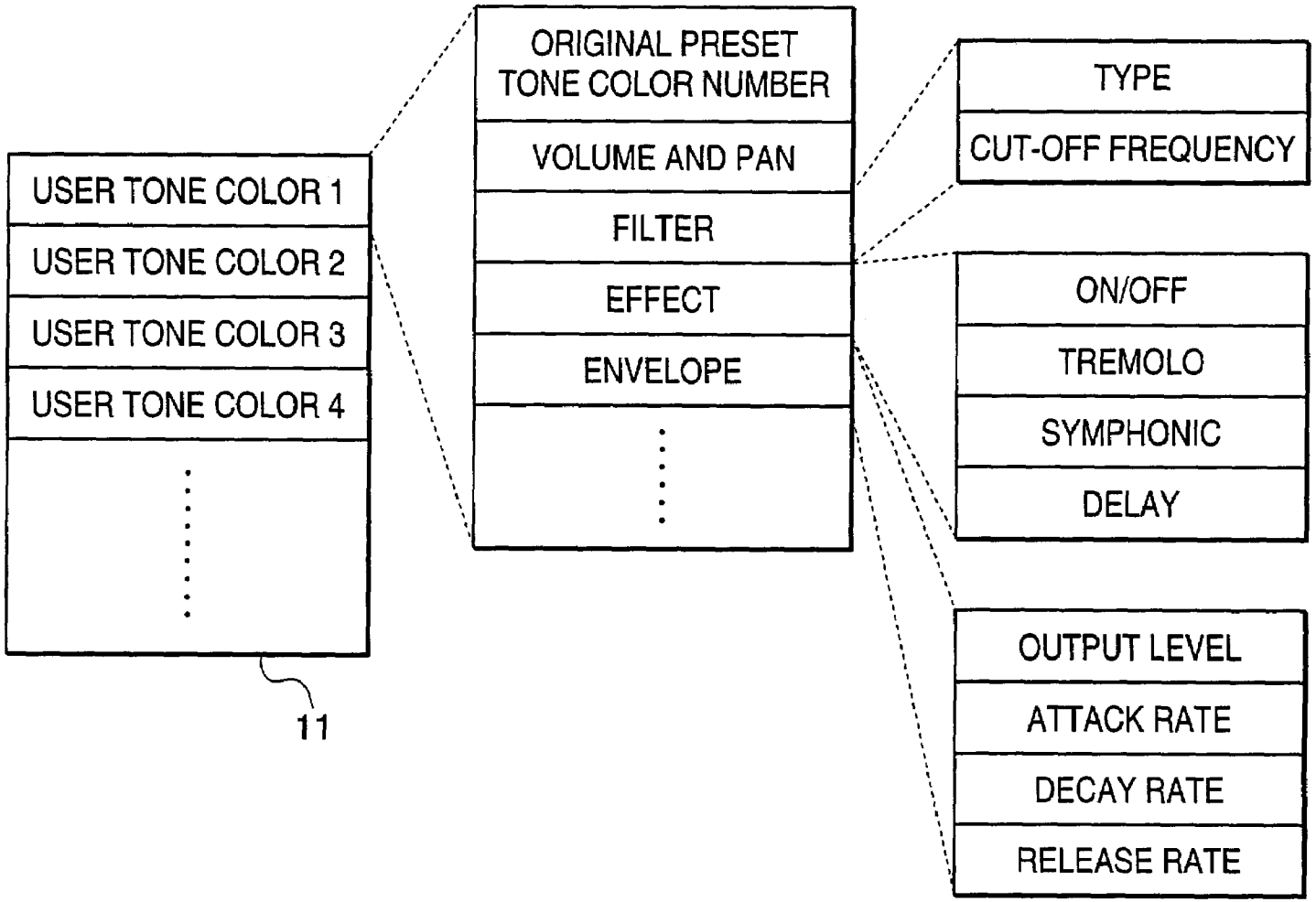
FIG. 6 is a diagram showing the contents of user tone color data stored in a flash memory 11 in FIG. 1.

FIG. 6 is a diagram showing the contents of user tone color data stored in the flash memory 11 in FIG. 1.

The user tone color data is data produced by the user by editing original preset tone color data.

The flash memory 11 is capable of storing twelve user tone color data in total, and each user tone color data is comprised of tone color parameters relating to an original preset tone color number, volume and pan, filter, effect, and envelope.

Considering that low grade electronic musical instruments cannot generate a musical tone signal based on user tone color data, the tone color parameter relating to the original preset tone color number is intended to enable such low grade electronic musical instruments to generate a musical tone signal based on preset tone color data. The tone color parameter relating to the filter is comprised of one set of a parameter representing the type of the filter and a parameter representing the cut-off frequency of the filter. The tone color parameter relating to the effect is comprised of one set of a parameter representing the ON/OFF state of the effect and parameters relating to the tremolo, symphonic, and delay that represent the type of the effect. The tone color parameter relating to the envelope is comprised of one set of a parameter representing the output level and parameters relating to the attack rate, decay rate, and release rate.

Intermediate and high grade electronic musical instruments are provided with the flash memory 11, but the intermediate grade electronic musical instruments can store a smaller number of user tone color data and a smaller number of types of tone color parameters (except for tone color numbers) compared with the high grade electronic musical instruments. For example, some intermediate grade electronic musical instruments are not capable of setting the filter or the effect and thus cannot deal with some user tone color data that is used by high grade electronic musical instruments. As described above, low grade electronic musical instruments cannot handle user tone color data themselves, that is, the low grade electronic musical instruments has no memory that stores user tone color data, and cannot generate a musical tone signal based on the user tone color data.

It should be noted that if user tone color data and musical tone waveform data, not shown, correspond to each other on a one-to-one basis, the tone color numbers of the user tone color data also specify musical tone waveform numbers of musical tone waveform data.

FIG. 7 is a diagram showing the contents of the external storage device 10, which are taken into the electronic musical instrument 100.

Assuming that the external storage device 10 is an FD drive including an FD, the FD includes the contents, i.e. registration data as shown in FIG. 7. The registration data includes all of the conditions during performance such as the tone color and the keyboard settings.

Tone color parameters constituting preset tone color numbers or user tone color data constitute a part of the registration data, and they are included as program change commands or exclusive commands in musical composition data and read into the electronic musical instrument 100 in automatic performance.

Each registration data in FIG. 7 includes parameters relating to the tempo, volume, tone color, and style. Among these parameters, the parameter relating to the tone color is comprised of parameters relating to an original preset tone color number, volume and pan, filter, effect, and envelope.

Low grade electronic musical instruments accept nothing but preset tone color numbers stored in advance, but they are capable of capturing commercially available registration data recorded in an FD or registration data prepared by the user, for example, so as to be compatible with intermediate and high grade electronic musical instruments.

Further, low grade electronic musical instruments are incapable of editing tone color parameters, but they are capable of storing, in an FD, registration data with the value of the tempo, the value of the tone volume, the tone color number, and/or the style number having been changed.

Figure 8:
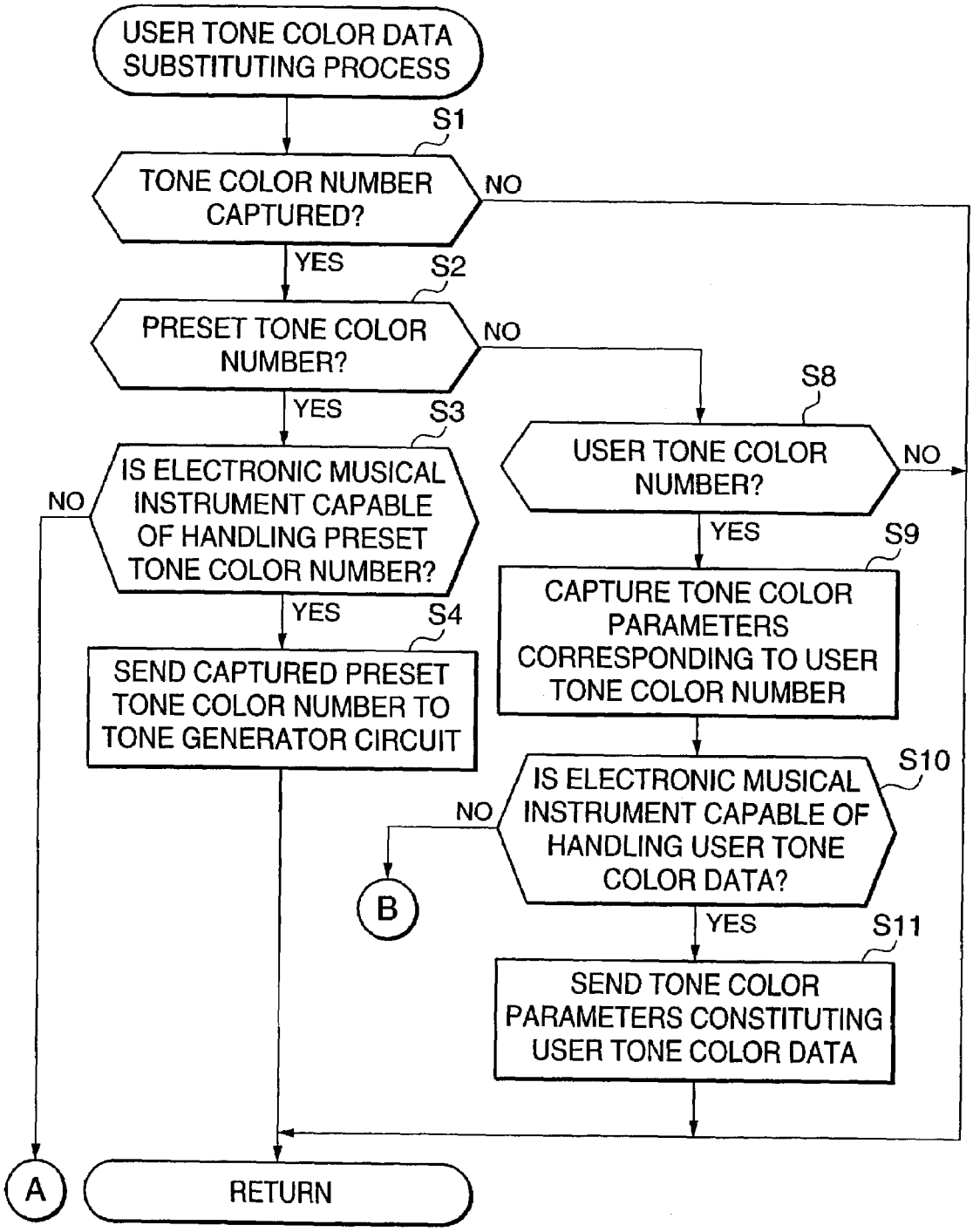
FIG. 8 is a flow chart showing a user tone color data substituting process carried out by a CPU 5 in FIG. 1.

FIGS. 8 and 9 are flow charts showing a user tone color data substituting process carried out by the CPU 5 in FIG. 1.

The user tone color data substituting process is roughly classified into the following seven processes:

(1) a substituting process carried out in the case where a preset tone color number that corresponds to user tone color data to be processed is stored in the ROM 6 (step S4);

(2) a substituting process carried out in the case where a preset tone color number that corresponds to user tone color data to be processed is not stored in the ROM 6, but another preset tone color number belonging to the same group is stored in the ROM 6 (step S6);

(3) a substituting process carried out in the case where a preset tone color number that corresponds to user tone color data to be processed is not stored in the ROM 6, and another preset tone color number belonging to the same group is not stored in the ROM 6 (step S7);

(4) a substituting process carried out in the case where user tone color data to be processed is stored in the flash memory 11 (step S11);

(5) a substituting process carried out in the case where user tone color data to be processed is not stored in the flash memory 11 and the user tone color data has no original preset tone color number (step S12);

(6) a substituting process carried out in the case where user tone color data to be processed is not stored in the flash memory 11 but the user tone color data has an original preset tone color number and the original preset tone color number is stored in the ROM 6 (step S12); and (7) a substituting process carried out in the case where user tone color data to be processed is not stored in the flash memory 11 and the user tone color data has an original preset tone color number but the original preset tone color number is not stored in the ROM 6 (step S13).

A detailed description will now be given of these processes.

The substituting process (1) is carried out in the case where the electronic musical instrument 100 has preset tone color data identical with that of another electronic musical instrument.

First, the CPU 5 determines whether a tone color number has been captured or not from the registration data stored in an FD or from the ROM 6 (step S1). If the determination result is positive, the CPU 5 then determines whether the captured tone color number is a preset tone color number or not (step S2).

If it is determined in the step S2 that the captured tone color number is the preset tone color number, it is then determined whether the preset tone color number can be handled by the electronic musical instrument 100 or not (step S3). The CPU 5 makes this determination based on the preset tone color table in FIG. 3.

If it is determined in the step S3 that the captured preset tone color number can be handled by the electronic musical instrument 100, the captured preset tone color number is sent to the tone generator circuit 12 (step S4), followed by the process being terminated. The tone generator circuit 12 generates a musical tone signal based on preset tone color data corresponding to the received preset tone color number.

The substituting process (2) is carried out, for example, in the case where a preset tone color number "2" designating "Brite Piano" belonging to a group of pianos is captured into the electronic musical instrument 100 if it is a low grade electronic musical instrument that is capable of handling only a preset tone color number "1" designating "Grand Piano" and a preset tone color number "3" designating "Ele Piano" belonging to the group of pianos.

If it is determined in the step S3 that the captured preset tone color number cannot be handled by the electronic musical instrument 100, the CPU 5 then determines whether or not the tone color table shown in FIG. 3 includes any other preset tone color numbers that belong to the same group as the captured preset tone color number and can be handled by the electronic musical instrument 100 (step S5).

If it is determined in the step S5 that the tone color table contains other preset tone color numbers that belong to the same group as the captured preset tone color number and can be handled by the electronic musical instrument 100, the most basic preset tone color number among these preset tone color numbers is sent as an alternative tone color number to the tone generator circuit 12 (step S6), followed by the process being terminated. The tone generator circuit 12 generates a musical tone signal based on preset tone color data corresponding to the received tone color number. The most basic preset tone color number means, for example, a tone color number that is the smallest numerical value in each group in the preset tone color table in FIG. 3. For example, the most basic preset tone color number is "1" designating "Grand Piano" in the "Piano" group, and the most basic preset tone color number is "6" designating "Celesta" in the "Chro-Percussion" group.

The above described substituting process (2) thus enables the electronic musical instrument 100 to provide performance in a tone color closer to or similar to a desired tone color because an alternative tone color number belonging to the same group is sent to the tone generator circuit 12.

The substituting process (3) is carried out, for example, in the case where a preset tone color number "11" designating "Draw Organ" belonging to a group of organs is captured into the electronic musical instrument 100 if it is a low grade electronic musical instrument that is capable of handling only the preset tone color number "1" designating "Grand Piano" and the preset tone color number "3" designating "Ele Piano" belonging to the group of pianos.

If it is determined in the step S5 that the tone color table does not contain any other preset tone color numbers belonging to the same group as the captured preset tone color number and can be handled by the electronic musical instrument 100, a predetermined preset tone color number is sent to the tone generator circuit 12 regardless of the captured preset tone color number (step S7). The tone generator circuit 12 generates a musical tone signal based on preset tone color data corresponding to the received tone color number. The predetermined preset tone color number is a preset tone color number that is set by the user using the panel switch 2, or a preset tone color number that is set by the manufacturer before the electronic musical instrument is shipped from a plant.

The substituting process (4) is carried out in the case where the electronic musical instrument 100 has user tone color data just identical with that of another electronic musical instrument.

If it is determined in the step S2 that the captured tone color number is not a preset tone color number, it is then determined whether the captured tone color number is a user tone color number or not (step S8). Specifically, the user tone color number is a tone color parameter identification number included in the registration data shown in FIG. 7 (i.e. a number corresponding to "tone color 1 (number)" in the upper column in FIG. 7).

If it is determined in the step S8 that the captured tone color number is a user tone color number, the CPU 5 captures tone color parameters corresponding to the user tone color number (step S9). Specifically, the tone color parameters are those relating to "original preset tone color number, volume and pan, filter, effect, and envelope" in the lower column in FIG. 7.

The CPU 5 then determines whether or not the tone color parameters captured in the step S9 correspond to the tone color parameters stored in the flash memory 11, that is, whether or not the electronic musical instrument 100 is capable of handling user tone color data (step S10).

If it is determined in the step S10 that the electronic musical instrument 100 is capable of handling the user tone color data, the tone color parameters constituting the user tone color data are sent to the tone generator circuit 12 (step S11), followed by the process being terminated. The tone generator circuit 12 generates a musical tone signal based on the received tone color parameters.

The substituting process (5) is carried out in the case where a preset tone color number whose specific original preset tone color number is not set is captured into the electronic musical instrument 100 if it is a low grade electronic musical instrument that is capable of handling only the preset tone color number "1" designating "Grand Piano" and the preset tone color number "3" designating "Ele Piano".

If it is determined in the step S10 that the electronic musical instrument 100 is not capable of handling the user tone color data, the CPU 5 then determines whether the parameter of the original preset tone color number constituting a part of the tone color parameters captured in the step S9 has a specific number or not (step S12).

If it is determined in the step S12 that the parameter of the original preset tone color number has no specific number, a predetermined preset tone color number is sent to the tone generator circuit 12 regardless of the original preset tone color number and the user tone color number (step S15), followed by the process being terminated. The tone generator circuit 12 generates a musical tone signal based on preset tone color data corresponding to the received tone color number.

The substituting process (6) is carried out, for example, in the case where a user tone color number having an original preset tone color number "1" designating "Grand Piano" is captured into the electronic musical instrument 100 if it is a low grade electronic musical instrument that is capable of handling only the preset tone color number "1" designating "Grand Piano" and the preset tone color number "3" designating "Ele Piano".

If it is determined in the step S12 that the parameter of the original preset tone color number has a specific number, it is then determined whether the specific tone color number can be handled by the electronic musical instrument 100 (step S13). The CPU 5 makes this determination based on the preset tone color table in FIG. 3.

If it is determined in the step S13 that the specific tone color number can be handled by the electronic musical instrument 100, the original preset tone color number is sent as an alternative to the user tone color number to the tone generator circuit 12 (step S14), followed by the process being terminated. The tone generator circuit 12 generates a musical tone signal based on preset tone color data corresponding to the received original preset tone color number.

The above described substituting process (6) enables the electronic musical instrument 100 to provide performance in a tone color closer to or similar to a desired tone color because an original preset tone color as a basis of a user tone color is sent as an alternative tone color to the tone generator circuit 12.

The substituting process (7) is carried out, for example, in the case where a user tone color number having an original preset tone color number "2" designating "Brite Piano" is captured into the electronic musical instrument 100 if it is a low grade electronic musical instrument that is capable of handling only the preset tone color number "1" designating "Grand Piano" and the preset tone color number "3" designating "Ele Piano".

If it is determined in the step S13 that the specific tone color number cannot be handled by the electronic musical instrument 100, the process proceeds to the step S5 wherein the substituting process (2) (step S6) or the substituting process (3) (step S7) is carried out.

As described above, according to the present embodiment, if the electronic musical instrument 100 is incapable of handling a user tone color number and the CPU 5 of the electronic musical instrument 100 captures the user tone color number having an original preset tone color number, the original preset tone color number as a basis of a user tone color is sent as an alternative tone color number to the tone generator circuit 12. This enables the electronic musical instrument to provide listenable performance by using data reflecting the intention of the user among usable data.

Further, if the electronic musical instrument 100 is incapable of handling a predetermined preset tone color number (e.g. the preset tone color number "2" designating "Brite Piano") and the CPU 5 of the electronic musical instrument 100 captures the predetermined preset tone color number, an alternative tone color number (e.g. the tone color number "1" designating "Grand Piano") belonging to the same group (e.g. a group of pianos) as the predetermined preset tone color number is sent to the tone generator circuit 12. This also realizes listenable performance by using data reflecting the intention of the user-among usable data.

A description will now be given of a second embodiment of the present invention. The second embodiment is different from the above described first embodiment in the contents of user tone color data stored in the flash memory 11. The second embodiment is also different from the first embodiment in that each preset tone color number stored in the ROM 6 includes two musical tone waveform numbers.

A description will now be given of the difference from the first embodiment.

Figure 10:
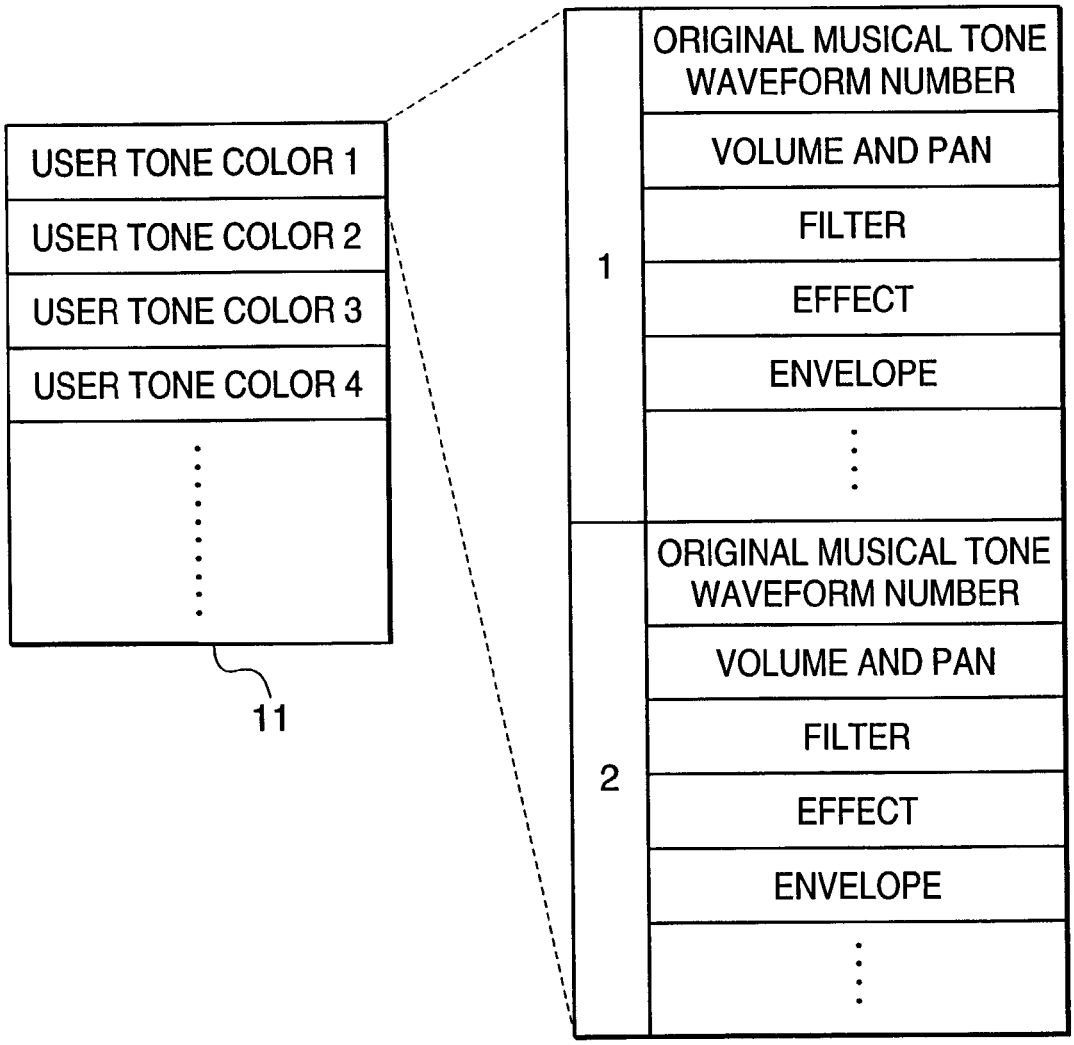
FIG. 10 is a diagram showing the contents of user tone color data stored in the flash memory 11 in FIG. 1.

FIG. 10 is a diagram showing the contents of user tone color data stored in the flash memory 11.

The flash memory 11 is capable of storing twelve user tone color data in total, and each user tone color data is comprised of two pairs of sets of tone color parameters relating to an original musical tone waveform, volume and pan, filter, effect, and envelope. This means that, in the present embodiment, one user tone color or one preset tone color to be used is composed based on two musical tone waveforms and parameters thereof. Depending on the types of tone colors, however, one user tone color or one preset tone color to be used may be composed based on one musical tone waveform and parameters thereof.

Considering that low grade electronic musical instruments cannot generate a musical tone signal based on user tone color data, tone color parameters relating to original musical tone waveform numbers are intended to enable such low grade electronic musical instruments to generate a musical tone signal based on preset tone color data.

FIG. 11 is a diagram showing a conversion table for use in extracting a preset tone color number and the like based on the original musical tone waveform number(s) in FIG. 10.

This conversion table is provided in the ROM 6, and is used mainly when a low grade electronic musical instrument captures user tone color data.

In the conversion table in FIG. 11, a column "original musical tone waveform" designates parameters of original musical tone waveform numbers contained in the user tone color data in FIG. 10. A column "tone color number" designates preset tone color numbers converted based on the parameters of original musical tone waveform numbers, a column "tone color name" designates tone color names corresponding to the preset tone color numbers, and columns "first musical tone waveform" and "second musical tone waveform" designate musical tone waveform numbers stored in the ROM 6. "0" in the column "first musical tone waveform" or the "second musical tone waveform" means that only one musical tone waveform is used to generate a musical tone signal.

In the conversion table in FIG. 11, for example, for the "1, 2" in the column "original musical tone waveform", two kinds of tone color numbers "001" and "003" are listed as candidates for conversion. This means that the original musical tone color number is to be converted into one of the tone color numbers "001" and "003" according to four parameters of the volume and pan, filter, effect, and envelope relating to the original musical tone waveform number "1" included in the user tone color data. In the case where two numbers are listed in the column "original musical tone waveform", preset tone color numbers to be listed in the column "tone color number" are determined according to the smaller original musical tone waveform number.

FIG. 12 is a diagram showing the contents of the external storage device 10, which are captured into the electronic musical instrument 100.

Assuming that the external storage device 10 is an FD drive including an FD, the FD includes the contents, i.e. registration data shown in FIG. 12.

The registration data in FIG. 12 is different from the above described registration data in FIG. 7 in that two sets of tone color parameters are provided for one user tone color, and one of elements constituting the tone color parameters is not an original preset tone color number but an original musical tone waveform number.

Figure 13:
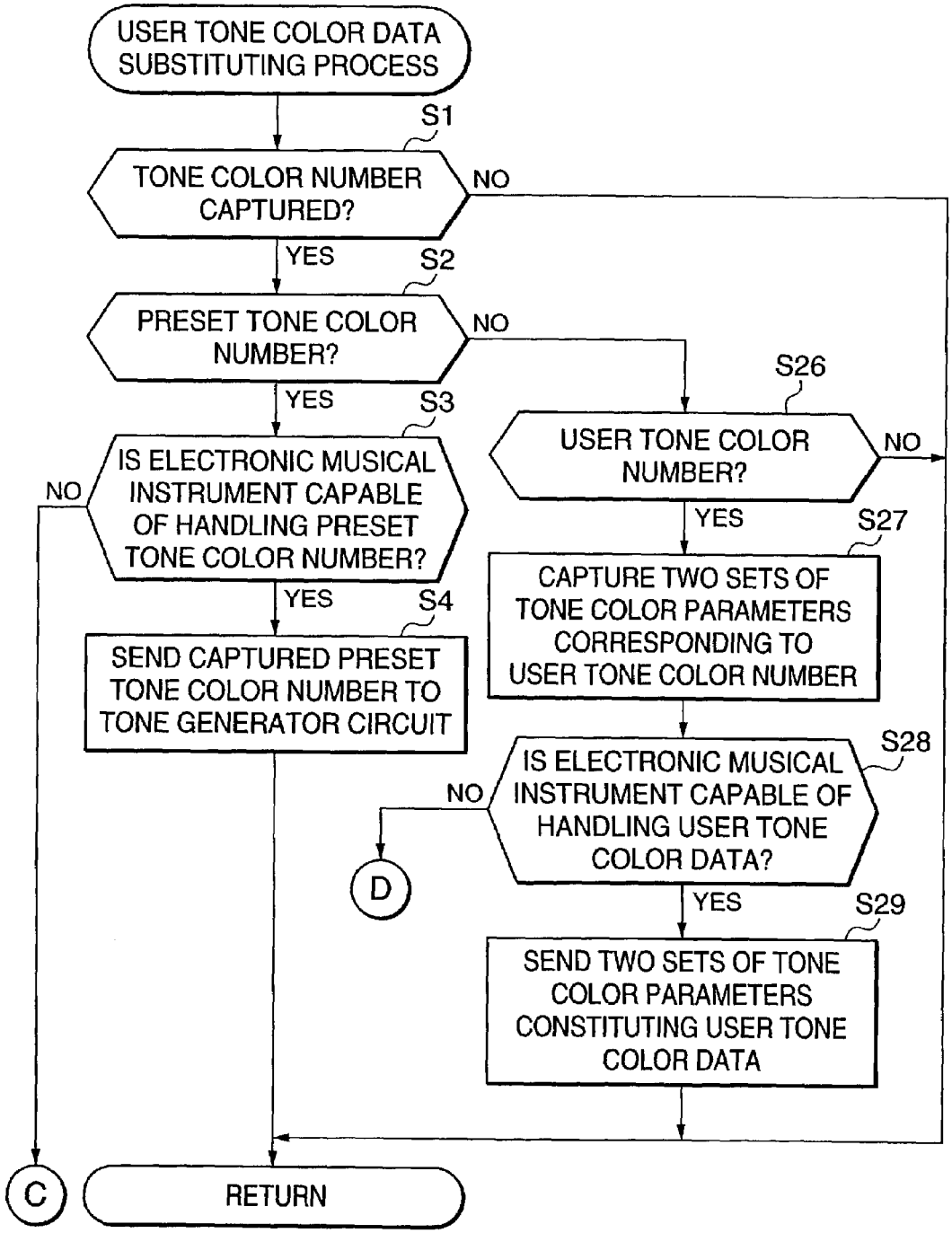
FIG. 13 is a flow chart showing a user tone color data substituting process carried out by the CPU 5 in FIG. 1.
Figure 14:
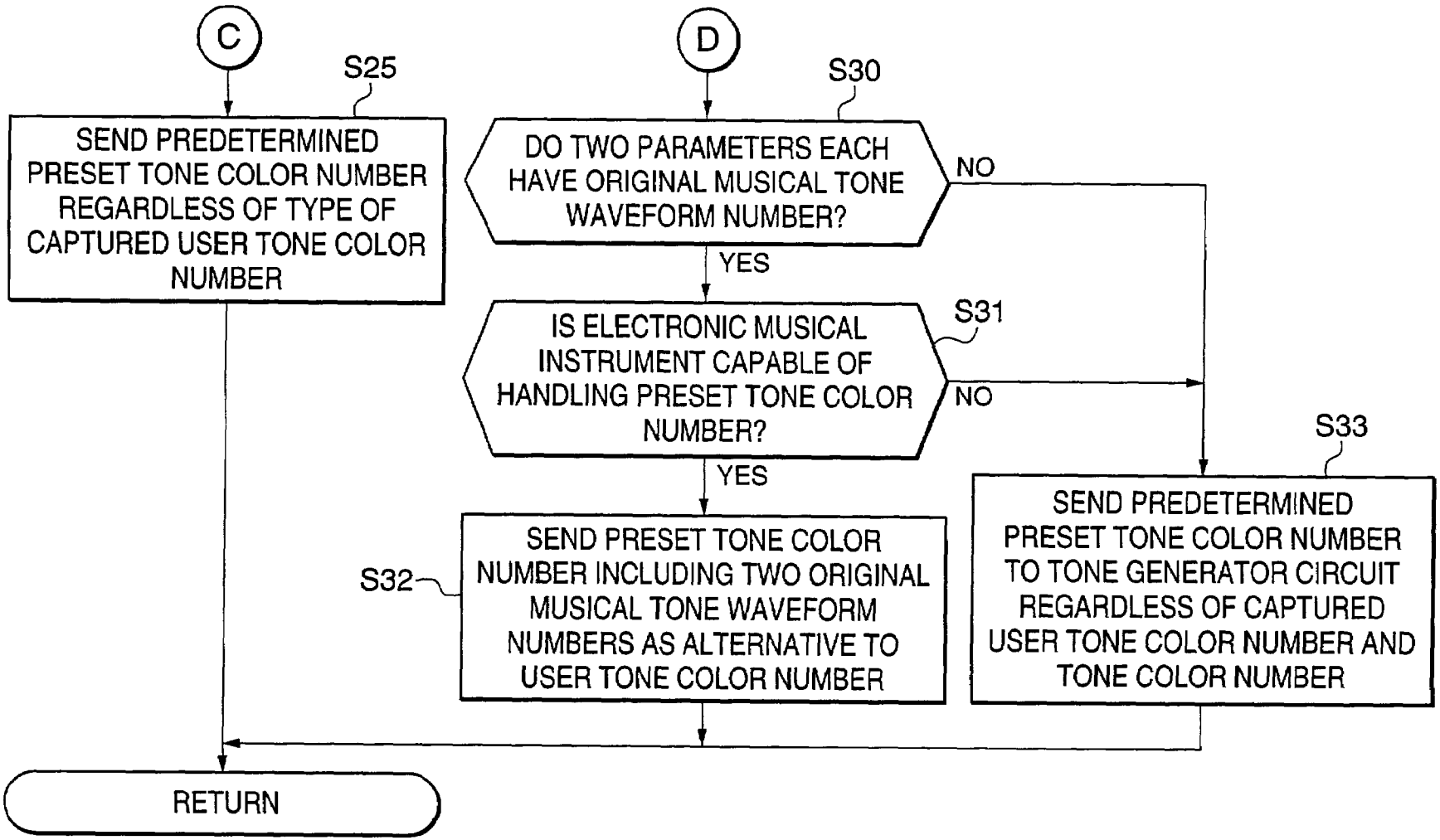
FIG. 14 is a flow chart showing a continued part of the user tone color data substituting process carried out by the CPU 5 in FIG. 1.

FIGS. 13 and 14 are flow charts showing a user tone color data substituting process carried out by the CPU 5 in FIG. 1.

The processes in steps S1 to S4 in FIG. 13 are identical with the above described processes in the steps S1 to S4 in FIG. 8, and a description thereof is omitted.

The user tone color data substituting process is roughly classified into the following five processes:

(8) a substituting process carried out in the case where a preset tone color number that corresponds to user tone color data to be processed is stored in the ROM 6 (step S4) (this substituting process (8) is identical with the substituting process (1) of the first embodiment, and a description thereof is omitted.);

(9) a substituting process carried out in the case where a preset tone color number that corresponds to user tone color data to be processed is not stored in the ROM 6 (step S25);

(10) a substituting process carried out in the case where user tone color data to be processed is stored in the flash memory 11 (step S29);

(11) a substituting process carried out in the case where user tone color data to be processed is not stored in the flash memory 11 and user tone color data has no original musical tone waveform number or user tone color data has an original musical tone waveform number but the original musical tone waveform number is not stored in the ROM 6 (step S33); and

(12) a substituting process carried out in the case where user tone color data to be processed is not stored in the flash memory 11 but the user tone color data has an original musical tone waveform number and the original musical tone waveform number is stored in the ROM 6 (step S32).

A description will now be given of these processes.

The substituting process (9) is carried out, for example, in the case where the preset tone color number "11" designating "Draw Organ" is captured into the electronic musical instrument 100 if it is a low grade electronic musical instrument that is capable of handling only the preset tone color number "1" designating "Grand Piano" and the preset tone color number "3" designating "Ele Piano".

If it is determined in the step S3 that the captured preset tone color number cannot be handled by the electronic musical instrument 100, a predetermined preset tone color number is sent to the tone generator circuit 12 regardless of the captured preset tone color number (step S25), followed by the process being terminated. The tone generator circuit 12 generates a musical tone signal based on preset tone color data corresponding to the received tone color number. The predetermined preset tone color number is a preset tone color number that is set by the user using the panel switch 2, or a preset tone color number that is set by the manufacturer before the electronic musical instrument is shipped from a plant.

The substituting process (10) is carried out in the case where the electronic musical instrument 100 has user tone color data identical with that of another electronic musical instrument.

If it is determined in the step S2 that the captured tone color number is not a preset tone color number, the CPU 5 then determines whether the captured tone color number is a user tone color number or not (step S26). Specifically, the user tone color number is a tone color parameter identification number included in the registration data shown in FIG. 7 (i.e. a number corresponding to "tone color 1 (number)" in the upper column in FIG. 12).

If it is determined in the step S26 that the captured tone color number is a user tone color number, the CPU 5 captures two sets of tone color parameters corresponding to the user tone color number (step S27). The two sets of tone color parameters are parameters relating to "original preset tone color number, volume and pan, filter, effect, and envelope" in the lower column in FIG. 12.

The CPU 5 then determines whether or not the tone color parameters captured in the step S27 correspond to tone color parameters stored in the flash memory 11, that is, whether or not the electronic musical instrument 100 is capable of handling user tone color data (step S28).

If it is determined in the step S28 that the electronic musical instrument 100 is capable of the user tone color data, the two sets of tone color parameters constituting the user tone color data are sent to the tone generator circuit 12 (step S11), followed by the process being terminated. The tone generator circuit 12 generates a musical tone signal based on the received two sets of tone color parameters.

The substituting process (11) is carried out, for example, in the case where a user tone color number whose two original musical tone waveform numbers are not set is captured into the electronic musical instrument 100 if it is a low grade electronic musical instrument that is capable of handling only the preset tone color number "1" designating "Grand Piano" and the preset tone color number "3" designating "Ele Piano". The substituting process (11) is also carried out in the case where a user tone color number whose two original musical tone waveform numbers are set is captured into the electronic musical instrument 100 if it is a low grade electronic musical instrument that is capable of handling only the preset tone color number "1" designating "Grand Piano" and the preset tone color number "3" designating "Ele Piano", and a preset tone color number corresponding to the two original musical tone numbers is "11" designating "Draw Organ".

If it is determined in the step S28 that the electronic musical instrument 100 is not capable of handling user tone color data, the CPU 5 then determines whether two parameters of the original musical tone waveform numbers constituting the tone color parameters captured in the step S27 each have a specific number or not (step S30).

If it is determined in the step S30 that the two parameters of the original musical tone waveform numbers do not have a specific number, a predetermined preset tone color number is sent to the tone generator circuit 12 regardless of the original preset tone color number and the user tone color number (step S33), followed by the process being terminated. The tone generator circuit 12 generates a musical tone signal based on preset tone color data corresponding to the received tone color number.

If it is determined in the step S30 that the two parameters of the original musical tone waveform numbers each have a specific number, it is then determined whether the preset tone color number corresponding to the two original musical tone waveform numbers can be handled by the electronic musical instrument 100 or not (step S31). The CPU 5 makes this determination based on the conversion table shown in FIG. 11.

If it is determined in the step S31 that the preset tone color number corresponding to the two original musical tone waveform numbers cannot be handled by the electronic musical instrument 100, the above described step S33 is carried out, followed by the process being terminated.

The substituting process (12) is carried out, for example, in the case where a user tone color number having two original musical tone waveform numbers corresponding to the preset tone color number "1" designating "Grand Piano" is captured into the electronic musical instrument 100 if it is a low grade electronic musical instrument that is capable of handling only the preset tone color number "1" designating "Grand Piano" and the preset tone color number "3" designating "Ele Piano".

If it is determined in the step S31 that the preset tone color number corresponding to the two original musical tone waveform numbers can be handled by the electronic musical instrument 100, the preset tone color number including the two original musical tone waveform numbers is sent as an alternative to the user tone color number to the tone generator circuit 12 (step S32), followed by the process being terminated. The tone generator circuit 12 generates a musical tone signal based on preset tone color data corresponding to the preset tone color number including the received two original musical tone waveform numbers.

The above described substituting process (12) enables the electronic musical instrument 100 to provide performance in a tone color closer to or similar to a desired tone color because a preset tone color number including two original musical tone waveform numbers as a basis of a user tone color is sent as an alternative tone color number to the tone generator circuit 12.

As described above, according to the present embodiment, if the electronic musical instrument 100 is incapable of handling a user tone color number and the CPU 5 thereof captures the user tone color number having two original musical tone waveform numbers, a preset tone color number including two original musical tone waveform numbers as a basis of a user tone color is sent as an alternative tone color number to the tone generator circuit 12. This enables the electronic musical instrument 100 to provide listenable performance by using data reflecting the intention of the user among usable data.

Although in the above described first and second embodiments, the CPU 5 reads a preset tone color number from the ROM 6 and sends the same to the tone generator circuit 12, which then generates a musical tone signal based on preset tone color data corresponding to the received tone preset tone color number, this is not limitative, but the CPU 5 may send preset tone color data (tone color parameters) or user tone color data from the ROM 6, the external storage device 10 or the flash memory 11 directly to the tone generator circuit 12, which then generates a musical tone signal based on the received preset tone color data or user tone color data.

Further, although in the above described first and second embodiments data relating to tone colors among musical tone control information is handled, but the above described embodiments may be applied to other musical tone control information such as effects and accompaniment styles. In particular, with respect to the effects, the preset effect table in FIG. 4 may be used instead of the preset tone color table in FIG. 3.

It is to be understood that the object of the present invention may also be accomplished by supplying a computer or the CPU 5 with a program code of software which realizes the functions of either of the above described embodiments, and causing the computer or the CPU 5 to read and execute the supplied program code.

In this case, the program code is supplied directly from a storage medium storing the program, or is installed by downloading from other computers, databases, or the like, not shown, via the Internet, commercial network, local area network, or the like.

The program code may take the form of an object code, a program code to be executed by an interpreter, script data to be supplied to an OS, or the like insofar as the functions of the above described embodiments can be realized by the computer.

It is also to be understood that the object of the present invention may also be accomplished by supplying a computer with a storage medium storing a program of software which realizes the functions of the above described embodiments, and causing the computer or the CPU 5 to read and execute the program stored in the storage medium.

Examples of the storage medium for supplying the program code include a RAM, a flexible disk, an optical disk, a magnetic-optical disk, a CD-ROM, an MO, a CD-R, a CD-RW, a DVD (a DVD-ROM or DVD-R), a magnetic tape, a nonvolatile memory card, and other ROMs insofar as they can store the program code.

Although in the above described first and second embodiments, the electronic musical instrument 100 is used as the electronic musical apparatus, this is not limitative, but a PC, a mobile PC, a game machine, a portable communication terminal such as a cellular phone, or the like may be used as the electronic musical apparatus.

What is claimed is:

1. An electronic musical apparatus comprising:

a tone generator that generates a musical tone signal based on musical tone control information, the musical tone control information including at least one of preset musical tone control information based on which said tone generator generates a musical tone and user musical tone control information which a user produces by editing the preset musical tone control information, an input that inputs the musical tone control information, and a controller that controls, when the input musical tone control information includes the user musical tone control information based on which said tone generator cannot generate a musical tone signal, said tone generator to generate the musical tone signal corresponding to the preset musical tone control information included in the input musical tone control information instead of generating the musical tone signal corresponding to the user musical tone control information.

2. An electronic musical apparatus according to claim 1, wherein said controller is operable when the input musical tone control information includes the user musical tone control information, but not the preset musical tone control information, for sending predetermined musical tone control information capable of being used by said tone generator as an alternative to the user musical tone control information to said tone generator, and for controlling said tone generator to generate a musical tone signal based on the predetermined musical tone control information.

3. An electronic musical apparatus according to claim 1, further comprising a storage that classifies a plurality of preset musical tone control information into groups according to characteristics thereof and stores the classified preset musical tone control information for each of the groups;

wherein said controller is operable when the preset musical tone control information as a basis of the user musical tone control information is incapable of being used by said tone generator, for sending preset musical tone control information belonging to the same group as the preset musical tone control information capable of being used by said tone generator to said tone generator and for controlling said tone generator to generate a musical tone signal based on the sent preset musical tone control information.

4. An electronic musical apparatus according to claim 1, wherein the electronic musical apparatus is an apparatus selected from the group consisting of a personal computer, a mobile computer, a game machine, and a portable communication terminal.

5. An electronic musical apparatus comprising:

a tone generator capable of sounding musical tones based on preset tone color data including a plurality of musical tone waveform data to which are assigned corresponding numbers common to another electronic musical apparatus;

an input that inputs tone color data relating to musical tones to be sounded;

a storage that stores a plurality of preset tone color data including a plurality of musical tone waveform data capable of being used by said tone generator; and a controller that is operable when the tone color data input by said input is user tone color data that cannot be used by said tone generator, the user tone color data being tone color data produced by a user by editing original tone color data as a basis thereof and the user tone color data including the data for identifying or specifying the original musical tone waveform as a basis thereof, for sending the data for identifying or specifying the original musical tone waveform among the plurality of preset tone color data stored in said storage as an alternative to the user tone color data to said tone generator and for controlling said tone generator to generate a musical tone signal based on the data for identifying or specifying the original musical tone waveform.

6. An electronic musical apparatus according to claim 5, wherein said controller is operable, when a plurality of data including the data for identifying or specifying the original musical tone waveform are included in the plurality of preset tone color data stored in said storage, for sending one preset tone color data including the data for identifying or specifying the original musical tone waveform among the plurality of data to said tone generator based on a preset order and for controlling said tone generator to generate a musical tone signal based on the one preset tone color data.

7. An electronic musical apparatus according to claim 5, wherein the electronic musical apparatus is an apparatus selected from the group consisting of a personal computer, a mobile computer, a game machine, and a portable communication terminal.

8. A storage device storing a program for electronic music, which is executed by a computer that includes a tone generator device capable of generating a musical tone signal based on musical tone control information, the musical tone control information including at least one of preset musical tone control information based on which said tone generator generates a musical tone and user musical tone control information which a user produces by editing the preset musical tone control information, the program comprising:

an input module that inputs the musical tone control information, and a control module that controls, when the input musical tone control information includes the user musical tone control information based on which said tone generator cannot generate a musical tone signal, said tone generator to generate the musical tone signal corresponding to the preset musical tone control information included in the input musical tone control information instead of generating the musical tone signal corresponding to the user musical tone control information.

9. A storage medium storing a program for electronic music, which is executed by a computer that includes a tone generator capable of sounding musical tones based on preset tone color data including a plurality of musical tone waveform data to which are assigned corresponding numbers common to another electronic musical apparatus, and a storage device that stores data to be used by the tone generator device, the program comprising:

an input module that inputs tone color data relating to musical tones to be sounded;

a storage module that stores a plurality of preset tone color data including a plurality of musical tone waveform data capable of being used by said tone generator; and a control module that is operable, when the tone color data input by said input module is user tone color data that cannot be used by said tone generator, the user tone color data being tone color data produced by a user by editing original tone color data as a basis thereof and the user tone color data includes the data for identifying or specifying the original musical tone waveform as a basis thereof, for sending the data for identifying or specifying the original musical tone waveform among the plurality of preset tone color data stored in said storage as an alternative to the user tone color data to said tone generator and for controlling said tone generator to generate a musical tone signal based on the data for identifying or specifying the original musical tone waveform.

* * * * *